US010792723B2

(12) United States Patent
Rossbach et al.

(10) Patent No.: US 10,792,723 B2
(45) Date of Patent: Oct. 6, 2020

(54) BINARY NOZZLE, SPRAY HEAD AND METHOD

(71) Applicant: SMS group GmbH, Duesseldorf (DE)

(72) Inventors: Axel Rossbach, Moenchengladbach (DE); Thomas Koch, Moenchengladbach (DE); Norbert Gober, Moenchengladbach (DE); Erdem Karakas, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 0 days.

(21) Appl. No.: 16/476,367

(22) PCT Filed: Jan. 9, 2018

(86) PCT No.: PCT/DE2018/100010
§ 371 (c)(1),
(2) Date: Jul. 8, 2019

(87) PCT Pub. No.: WO2018/130245
PCT Pub. Date: Jul. 19, 2018

(65) Prior Publication Data

US 2020/0078850 A1 Mar. 12, 2020

(30) Foreign Application Priority Data

Jan. 11, 2017 (DE) ..... 10 2017 100 438

(51) Int. Cl.
*B21D 37/16* (2006.01)
*B05B 7/06* (2006.01)
(Continued)

(52) U.S. Cl.
CPC ..... *B21D 37/16* (2013.01); *B05B 7/068* (2013.01); *B05B 7/0876* (2013.01);
(Continued)

(58) Field of Classification Search
CPC . B21D 37/16; B21D 37/18; B21J 3/00; B21K 29/00; B05B 7/06; B05B 7/068;
(Continued)

(56) References Cited

U.S. PATENT DOCUMENTS 3,559,447 A 2/1971 Bogart
4,758,142 A 7/1988 Voss et al.
(Continued)

FOREIGN PATENT DOCUMENTS

CN 1228365 A 9/1999
CN 1502415 A 6/2004
(Continued)

OTHER PUBLICATIONS

Machine Translation of DE-19633266-A1, Hohnerlein, Publication Year 1998, Total pp. 6 (Year: 2020).*
(Continued)

*Primary Examiner* — Teresa M Ekiert
*Assistant Examiner* — Sarkis A Aktavoukian
(74) *Attorney, Agent, or Firm* — Collard & Roe, P.C.

(57) ABSTRACT

A binary nozzle for atomizing a mixture of agent to be sprayed and spray air is connected to at least one supply duct via which the mixture or the agent to be sprayed can be supplied to the binary nozzle, wherein a valve is arranged between this supply duct and a nozzle outlet of the binary nozzle. A corresponding spray head and also a method for atomizing a mixture of agent to be sprayed and spray air uses a binary nozzle. The binary nozzle includes a nozzle body formed in a single piece and including the nozzle outlet, wherein a movable assembly of the valve is fastened to the nozzle body by a fastening element and/or held tight against the nozzle body by a spring device.

9 Claims, 2 Drawing Sheets

(51) Int. Cl.

| | |
|---|---|
| ***B05B 7/08*** | (2006.01) |
| ***B05B 7/12*** | (2006.01) |
| ***B05B 12/08*** | (2006.01) |
| ***B21J 1/06*** | (2006.01) |

(52) U.S. Cl.
CPC ..... *B05B 7/1272* (2013.01); *B05B 12/088* (2013.01); *B21J 1/06* (2013.01)

(58) Field of Classification Search
CPC ..... B05B 7/062; B05B 7/066; B05B 7/067; B05B 12/087
See application file for complete search history.

(56) References Cited

U.S. PATENT DOCUMENTS

| | | | | |
|---|---|---|---|---|
| 4,798,341 | A | 1/1989 | Gimple | |
| 5,785,252 | A | 7/1998 | Keim et al. | |
| 5,881,797 | A | 3/1999 | Hansen | |
| 6,123,270 | A | 9/2000 | Hara | |
| 6,691,932 | B1 | 2/2004 | Schultz et al. | |
| 7,017,334 | B2 | 3/2006 | Mayer et al. | |
| 8,425,214 | B2 | 4/2013 | Keim | |
| 8,480,823 | B1 | 7/2013 | Matsen et al. | |
| 8,524,312 | B2 | 9/2013 | Huda et al. | |
| 9,370,792 | B2 | 6/2016 | Wesselky et al. | |
| 2003/0155450 | A1 | 8/2003 | Renkl et al. | |
| 2004/0217212 | A1 | 11/2004 | Erhard et al. | |
| 2005/0035226 | A1 | 2/2005 | Schebesta et al. | |
| 2005/0211799 | A1 | 9/2005 | Van Steenkiste | |
| 2005/0242209 | A1* | 11/2005 | Holm | B05B 7/0475 239/451 |
| 2005/0251243 | A1 | 11/2005 | Seppala et al. | |
| 2007/0007699 | A1 | 1/2007 | Rynerson et al. | |
| 2007/0074656 | A1 | 4/2007 | Zhao et al. | |
| 2007/0131140 | A1 | 6/2007 | Aoki et al. | |
| 2008/0251243 | A1 | 10/2008 | Dimter et al. | |
| 2010/0116900 | A1 | 5/2010 | Wurz | |
| 2012/0036775 | A1 | 2/2012 | Sprouse et al. | |
| 2018/0200740 | A1 | 7/2018 | Rossbach et al. | |

FOREIGN PATENT DOCUMENTS

| | | | | |
|---|---|---|---|---|
| CN | 102513480 | A | 6/2012 | |
| CN | 102513481 | A | 6/2012 | |
| CN | 202497968 | U | 10/2012 | |
| CN | 103240374 | A | 8/2013 | |
| DE | 25 26 900 | A1 | 1/1977 | |
| DE | 2622818 | A1 | 12/1977 | |
| DE | 30 39 914 | A1 | 5/1982 | |
| DE | 87 12 350 | U1 | 11/1987 | |
| DE | 36 40 818 | C1 | 6/1988 | |
| DE | 37 09 666 | C1 | 11/1988 | |
| DE | 195 11 272 | A1 | 10/1996 | |
| DE | 19633266 | A1 * | 2/1998 | B05B 7/068 |
| DE | 102005010409 | A1 | 9/2006 | |
| DE | 10 2006 004 107 | B4 | 10/2008 | |
| DE | 10 2007 031 263 | A1 | 1/2009 | |
| DE | 10 2008 047 118 | A1 | 4/2010 | |
| EP | 0 114 137 | A1 | 7/1984 | |
| EP | 1 637 252 | A1 | 3/2006 | |
| FR | 2 115 663 | A5 | 7/1972 | |
| GB | 1 475 771 | A | 6/1977 | |
| JP | 2998904 | B2 | 1/2000 | |
| JP | 2015-033723 | A | 2/2015 | |
| KR | 20-19950008317 | Y1 | 10/1995 | |
| WO | 97/19773 | A1 | 6/1997 | |
| WO | 2013/142045 | A1 | 9/2013 | |
| WO | 2014/058885 | A1 | 4/2014 | |
| WO | 2017/012609 | A2 | 1/2017 | |

OTHER PUBLICATIONS

Notification of Reason for Refusal dated Nov. 20, 2019 in KR 10-2019-7020189.
International Search Report in PCT/DE2018/100010, dated Apr. 5, 2018.
German Office Action in DE 10 2017 100 438.6, dated Jul. 19, 2017, with English translation of relevant parts.
International Preliminary Report on Patentability in PCT/DE2018/100010 with English Translation dated Jul. 18, 2019.
Korean Office Action in KR Application No. 10-2019-7020189 dated Mar. 25, 2020.
International Search Report of PCT/DE2016/100316, dated Apr. 26, 2017.
German Office Action dated May 23, 2016 in German Application No. 10 2015 114 202.3, with English translation of relevant parts.
Additional Information from the International Office regarding PCT/DE2016/100316 dated Nov. 18, 2016 with an English translation of relevant parts.
English translation of the International Preliminary Report on Patentability in PCT/DE2016/100316 dated Jan. 23, 2018.
"The Development of Key Manufacturing Industries in the World", 2013, p. 202 (See Dec. 31, 2019 Chinese Office Action for relevance).
Chinese Office Action in Chinese Application No. 201680042126.2 dated Dec. 31, 2019 with English translation.

* cited by examiner

BINARY NOZZLE, SPRAY HEAD AND METHOD

CROSS REFERENCE TO RELATED APPLICATIONS

This application is the National Stage of PCT/DE2018/100010 filed on Jan. 9, 2018, which claims priority under 35 U.S.C. § 119 of German Application No. 10 2017 100 438.6 filed on Jan. 11, 2017, the disclosure of which is incorporated by reference. The international application under PCT article 21(2) was not published in English.

BACKGROUND OF THE INVENTION

1. Field of the Invention

The invention relates to a two-substance nozzle that atomizes a mixture of sprayed medium and spray air, which nozzle is connected with at least one feed channel, by way of which the mixture or the sprayed medium can be supplied to the two-substance nozzle, wherein a valve is disposed between this feed channel and a nozzle exit of the two-substance nozzle. Also, the invention relates to a spray head for cooling lubrication of at least one die of a forming machine having a lower die and an upper die, in particular a die-forging press, which spray head is introduced into a work space between lower and upper die between two work strokes, and carries at least one corresponding two-substance nozzle. Furthermore, the invention relates to a method for atomization of a mixture of sprayed medium and spray air by means of a two-substance nozzle, in which method the mixture or the sprayed medium is passed to the two-substance nozzle by way of a feed channel and a valve, and sprayed out by way of a nozzle exit of the two-substance nozzle.

2. Description of the Related Art

Such spray heads and two-substance nozzles are known, for example, from DE 10 2006 004 107 B1 or also from DE 195 11 272 A1. In this regard, the spray heads are essentially composed of a multi-layer plate arrangement, by means of which separate feed channels for the sprayed medium and the spray air as well as also corresponding valves, in particular membrane valves, and feed channels for control fluid, by means of which the membrane valves can be controlled, are made available. It is true that the plate-type spray heads have a relatively narrow construction, so that they can also get into smaller free spaces between the dies. However, the variability of use of these spray heads remains within certain limits.

A spray head disclosed by US 2004/217212 A1 makes great flexibility possible, since here, the individual two-substance nozzles can be separately and individually adjusted.

A completely different approach, in this regard, is disclosed by the as yet unpublished PCT/DE2016/100316, in which it is true that the individual nozzles are adjusted separately, but spray head having individually oriented two-substance nozzles can be made available quickly and easily, by means of a very simple production method, in each instance. Furthermore, solutions are disclosed there, by means of which dripping or other undesirable accumulations of liquid are supposed to be prevented. This particularly also includes a valve that is disposed in the immediate vicinity of the respective two-substance nozzle and ultimately is configured in one piece with the respective two-substance nozzle, with the exception of the movable modules. In this way, the disadvantages of US 2004/217212 A1, in particular, can be avoided, in which a significant distance can be found between a related valve and the related nozzle exit, wherein here, too, transitions between different modules need to be overcome.

SUMMARY OF THE INVENTION

It is the task of the present invention to make available a two-substance nozzle of the stated type and a corresponding spray head, as well as a method for atomization of a mixture of sprayed medium and spray air by means of a two-substance nozzle, in which nozzle, spray head, and method the two-substance nozzle can be made available in as simple and operationally reliable manner, and can also be operated in operationally reliable manner with regard to dripping.

The task of the invention is accomplished by means of a two-substance nozzle, a spray head, and a method having the characteristics of the independent claims. Further advantageous embodiments, possibly also independent thereof, are found in the dependent claims and the following description.

Thus, a two-substance nozzle that atomizes a mixture of sprayed medium and spray air, which nozzle is connected with at least one feed channel, by way of which the mixture or the sprayed medium can be supplied to the two-substance nozzle, wherein a valve is disposed between this feed channel and a nozzle exit of the two-substance nozzle, can be characterized in that the two-substance nozzle has a nozzle body that is configured in one piece and comprises the nozzle exit, and a movable module of the valve is attached to the nozzle body by means of an attachment body and/or braced against the nozzle body by means of a spring device. Such an embodiment allows utilization of the advantages that are disclosed in the arrangement according to PCT/DE2016/100316, on the one hand, in that a nozzle can be made available in simple and operationally reliable manner, in accordance with the individual requirements, wherein, however, great tightness is guaranteed by means of the attachment of the movable module of the valve by means of the separate attachment body or by means of the bracing of the movable module of the valve against the nozzle body by means of a spring device, and, in particular, dripping can be reduced to a minimum.

A spray head for cooling lubrication of at least one die and a forming machine having a lower die and an upper die, in particular of a die-forging press, which spray head is introduced into a work space between lower and upper die between two work strokes and carries at least one such two-substance nozzle, can be made available in correspondingly simple and operationally reliable manner, and can also be operated in operationally reliable manner with regard to dripping.

Also, a two-substance nozzle can be made available in the simplest and operationally most reliable manner and can also be operated in operationally reliable manner with regard to dripping, if a method for atomization of a mixture of sprayed medium and spray air by means of a two-substance nozzle, in which method the mixture or the sprayed medium is passed to the two-substance nozzle by way of a feed channel and a valve, and sprayed out by way of a nozzle exit of the two-substance nozzle, is characterized in that a movable module of the valve is pressed against the nozzle body by means of an attachment body and/or by means of a spring device.

In deviation from the solution according to PCT/DE2016/100316, which is essentially based on a one-piece nature of the nozzle body and of the valve, except for the movable module, in the present case the movable module is pressed against the nozzle body by means of a separate attachment body, or is attached to the nozzle body. In this way, significant simplification of assembly is obtained, since introduction of the movable module can only take place after formation of the nozzle body, wherein the movable module can then be attached to the nozzle body by means of the attachment body. In this regard, it is understood that such attachment preferably still allows sufficient mobility of the module, so that the latter can still fulfill its intended task as a movable module of the valve, for example sufficient opening and closing.

In this regard, it is understood that in the production of the attachment body as a separate module, can easily be formed at the same time with the nozzle body or with the remainder of the spray head, so that ultimately, no supplemental method step or only minimal additional method steps is/are necessary during production.

Attachment or pressing-on of the movable module by means of the attachment body can take place, in particular, in such a manner that the movable module lies against the nozzle body, forming a seal, in a partial region, so as to thereby separate the feed channel, for example, which passes the mixture or the sprayed medium to the nozzle exit by way of the valve, from a construction space in which a control fluid can be found, for example. On the other hand, it is conceivable that the movable module is attached to the nozzle body relatively loosely by means of the attachment body, while any sealing measures that might be necessary to separate feed channels that supply the mixture or the sprayed medium to the two-substance nozzle from other channels or spaces are provided at a different location.

If the movable module is braced or pressed against the nozzle body by means of a spring device, then depending on the concrete embodiment of the spring force and of the spring device, the movable module of the valve can be pressed against the nozzle body with a sufficient seal in all operational situations, so that it is only necessary to take possible dimensional accuracies or tolerances into account in restricted manner. On the other hand, the spring forces or the spring device can be selected in such a manner that in this way, valve control, for example by means of a control fluid, is supported, i.e. the valve can independently open or close counter to the pressure in the feed channel that supplies the mixture or the sprayed medium to the two-substance nozzle. In this way, depending on the concrete embodiment, control of the valve can be simplified, in that smaller cross-sections for control lines can be used or extremely practical control methods can be used, for example.

In particular, the attachment body can attach the spring device to the nozzle body, since spring devices, in particular if they are made available by way of a 3D printing method, can be made available only in the relaxed state, and then must still be tensed in an assembly step. Accordingly, it is conceivable to configure the spring device and the attachment body in one piece, and, during attachment of the attachment body to the nozzle body, to attach the spring device there, as well, and to bias it accordingly during this process. Likewise, it is conceivable, vice versa, to configure the spring device in one piece with the nozzle body, and then to bias it by means of the attachment device, in that the movable module is then affixed to the spring device.

In this regard, it is advantageous if the attachment body absorbs counter-forces of the spring device. This can also be a gas pressure, for example, if a gas pressure spring is used. Likewise, these can be directly acting spring forces, if mechanical springs are used. In this regard, it plays no role whether these mechanical springs are configured as a separate module or in one piece with the attachment body.

The valve, which is disposed between the feed channel that supplies the mixture or the sprayed medium to the two-substance nozzle and is assigned to the nozzle exit of the two-substance nozzle, can preferably be opened and closed by means of a pressure in this feed channel; this can be implemented, in particular, if a corresponding movable module, such as a valve lid or a valve membrane, has a corresponding spring pressure applied to it from the other side. This spring pressure is then preferably selected in such a manner that at a selected spray pressure, which in the feed channel through which the mixture or the sprayed medium is supplied to the two-substance nozzle, a sufficiently high pressure that exceeds a selected limit value is present, so that the valve opens, and the valve closes if this limit pressure is not met. In this manner, the valve can be controlled by means of controlling the pressure in this feed channel, so that it is possible to do without a separate feed channel for control fluid, which furthermore has to be controlled by way of a separate valve, accordingly, to open and close. If necessary, a gas pressure spring, which is operated using a specific pressure of a control fluid, for example, can also be used as the spring device. If the pressure in the feed channel by way of which the mixture or the sprayed medium is supplied to the two-substance nozzle, then exceeds the pressure of the control fluid, the movable module of the valve can be opened accordingly. It closes if the corresponding pressure drops below this value again.

It is understood that if necessary, the spring device can also be used only in supporting manner along with the use of a switched control fluid, so that only lower pressures and thereby also lower volume streams are necessary for the control fluid, and this can then also result in correspondingly smaller valves for the control fluid.

Depending on the concrete implementation, in particular when using a control fluid, for example, it can be desirable to connect the attachment body to the nozzle body in sufficiently gas-tight manner or with a sufficient seal, and this might make reworking necessary, since in the case of 3D printing, for example, the surfaces are relatively rough. Alternatively to this, sealing elements such as sealing rings or the like, for example, or also sealing agents or adhesives can be placed between the nozzle body and the attachment body, so as to produce a sufficiently tight seal in this manner. Since the attachment body no longer needs to be removed from the nozzle body after assembly, in many concrete embodiments, adhesive connections, which cannot be released again without destroying them, can certainly be used in this regard.

For the remainder, it is also conceivable that the attachment body is not connected with the nozzle body in releasable, destruction-free manner.

In particular, the two-substance nozzle and the valve, except for the movable modules of the valve and of the attachment body, as well as any adhesives or sealing agents, such as a sealing ring, for example, can be configured in one piece. This results in a particularly simple production possibility of the two-substance nozzle or of a corresponding spray head, in particular also by means of 3D printing.

As was already explained above, it is advantageous if the attachment body is tightly connected with the nozzle body. This holds true, in particular, if the valve is supposed to be switched using a control fluid or counter to the gas pressure of a control fluid, so that here, the attachment body can have a sealing effect against exiting of the control fluid. In particular, sealing agents or adhesives, as already discussed above, can serve for this purpose.

Preferably, the movable module is a valve lid of the valve, which lid can also be configured, in particular, as a membrane. Also, the movable module can be a press-down spring, by means of which a further movable module, for example, such as the valve lid, for example, can be pressed against the nozzle body.

In order to prevent possible dripping as effectively as possible, or to minimize the risk of such dripping, it is advantageous if the distance between the nozzle exit and the valve amounts to not more than 10 times the maximal diameter of the nozzle exit. In this manner, an amount of water remaining between the valve and the nozzle exit is relatively slight when the valve is closed. Such a small amount of water can then be transported away by means of the partial vacuum, for example, that can still be made available in the two-substance nozzle by means of the spray air or by means of the second substance flow of the two-substance nozzle. Further dripping is then effectively prevented by the valve, or its effect is minimized.

Also, dripping can be prevented or the risk of dripping can be minimized if the two-substance nozzle has a straight-line path for the mixture or the sprayed medium between the valve and the nozzle exit, so that the risk of possible fluid accumulations of the sprayed medium on the path between valve and nozzle exit, which could lead to undesirable dripping, can be minimized.

In total, it is advantageous if the individual two-substance nozzles are configured to be as small as possible, so that the spray profile can be selected in very individual manner. Also, such a small configuration guarantees corresponding advantages in the tight seal of the valve, with a simple configuration of the two-substance nozzle. Larger arrangements are subject to significantly more complex general conditions, in this regard. Accordingly, it is advantageous if the diameter of the nozzle exit is smaller than 20 mm. This brings about the result that the diameter of the sprayed medium exit, accordingly, is preferably smaller than 18 mm.

Cumulatively or alternatively to this, it is advantageous if the diameter of the nozzle exit is greater than 0.5 mm, since in the case of smaller arrangements, a more complex nozzle structure might appear necessary, so as to guarantee atomization by way of the two-substance nozzle in sufficiently operationally reliable manner. In this regard, it is accordingly advantageous if the sprayed medium exit has a diameter greater than 0.4 mm.

It is understood that the characteristics of the solutions described above and in the claims can also be combined, if applicable, so as to be able to implement the advantages cumulatively, accordingly.

BRIEF DESCRIPTION OF THE DRAWINGS

Further advantages, goals, and properties of the present invention will be explained using the following description of exemplary embodiments, which are particularly also shown in the attached drawing. The drawing shows.

DETAILED DESCRIPTION OF THE PREFERRED EMBODIMENTS

Figure 1:
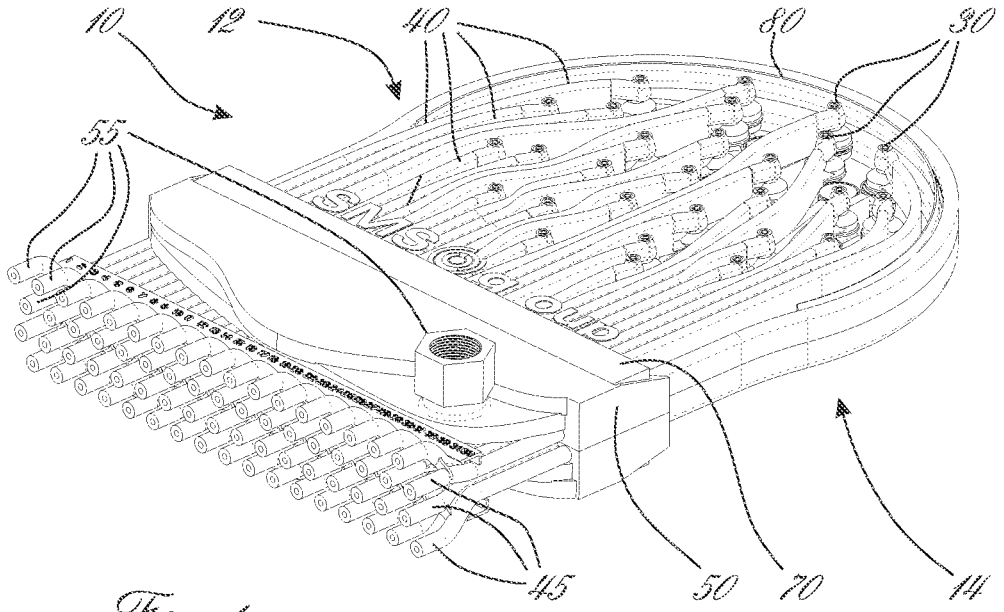
FIG. 1 a spray head in a perspective view, with multiple two-substance nozzles.

The spray head 10 shown in FIG. 1 has a top side 12 and an underside 14, wherein it has a two-part housing 70, on the one hand, which housing comprises two-substance nozzles 30 directed upward in a first part and corresponding feed channels 40, and two-substance nozzles 30 directed downward in a second part, and corresponding feed channels 40, and on the other hand has a spray head foot 50, which carries a plurality of supply connectors 55, wherein these are combined in the spray head foot 50, proceeding from the housing 70, in accordance with the required control possibility.

In the case of the present concrete exemplary embodiment, the feed channels 40 serve as sprayed medium channels 45, spray air channels 46 or control channels 47 (see FIG. 2), wherein the control channels 47 and the spray air channels 46 are combined, for the spray head foot 50, in the supply connectors 55, for the upper part of the housing 70 and the lower part of the housing 70, in each instance, and the sprayed medium channels 45 are each passed out individually as supply connectors 55, in each instance, so that these can have a sprayed medium pressure applied to them individually and under the control of separate valves.

The two parts of the housing 70 each have an essentially semi-circular atomization nozzle 80, which serves to secure the spray head 10 if it were to be exposed to overly high temperatures.

The individual two-substance nozzles 30 are each configured as Laval nozzles 31, and comprise a one-piece nozzle body 32, which forms a spray air exit 33 and a sprayed medium exit 34 of the Laval nozzle 31, in each instance, and makes a transition, in one piece, into the feed channels 40, which each comprise a sprayed medium channel 45, a spray air channel 46, and a control channel 47. In this regard, the spray air channels 46 and the control channels 47 are each combined in the spray head 10.

A valve 60 is formed on the nozzle body 32, in each instance, which valve has a membrane-type valve lid 65, which is pressed against the nozzle body by means of an attachment body 61 and a spring device 60 69, or attached to it.

A sealing ring 62 is provided between the attachment body 61 and the nozzle body 32, so that the attachment body 61 closes off the control channel 47, forming a seal, on the one hand, and consequently makes available a spring device 69 that acts like a gas spring, and, on the other hand, presses the valve lid 65 tightly against the nozzle body 32 on the outside of the valve lid 65.

If the pressure in the sprayed medium channel 45 now exceeds the pressure in the control channel 47, then the valve lid 65 will open counter to the gas pressure of the spring device 69. If the pressure is reduced accordingly, then the valve 60 will close due to the higher pressure in the control channel 47 or in the spring device 69.

It is understood that instead of the configuration of the spring device 69 as a gas pressure spring, a conventional helical spring or a plate spring, for example, can also be used at this location. In this regard, the corresponding mechanical spring can then be pressed against the valve lid 65 by means of the attachment body 61, for example, so as to make the spring force available in this manner. In this regard, it is understood that the attachment body 61 and the mechanical spring device can then also be configured in one piece with one another.

In a deviating embodiment, the control channel 47 can also be separated from the spray air channel 46. Then the sprayed medium channels 45 can preferably be combined to form one common or two supply connectors 55, so as to be able to pass the control channels 47 out individually, in each instance, and to control them in targeted manner.

Figure 2:
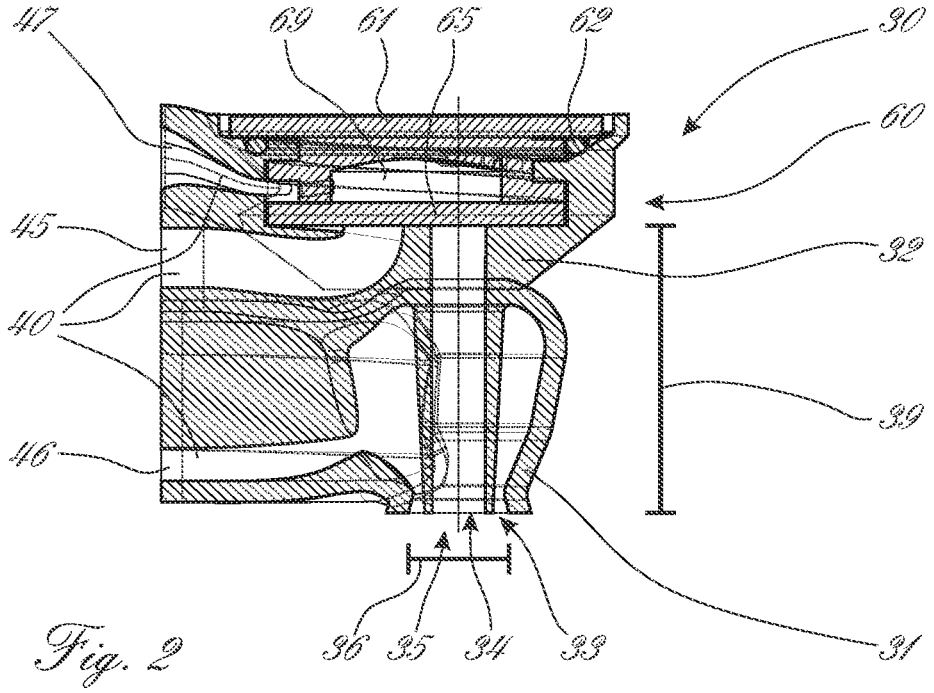
FIG. 2 a schematic section through one of the two-substance nozzles of the spray head according to FIG. 1.

As can be seen in FIG. 2, the spray air exit 33 also defines a nozzle exit 35 having a diameter 36, wherein the distance 39 between the nozzle exit 35 and the valve 60 amounts to approximately 3 times the diameter 36 of the nozzle exit 35. Depending on the concrete implementation, the distance 39 can be selected between 0.5 times and 10 times the diameter 36 of the nozzle exit 35.

Figure 3:
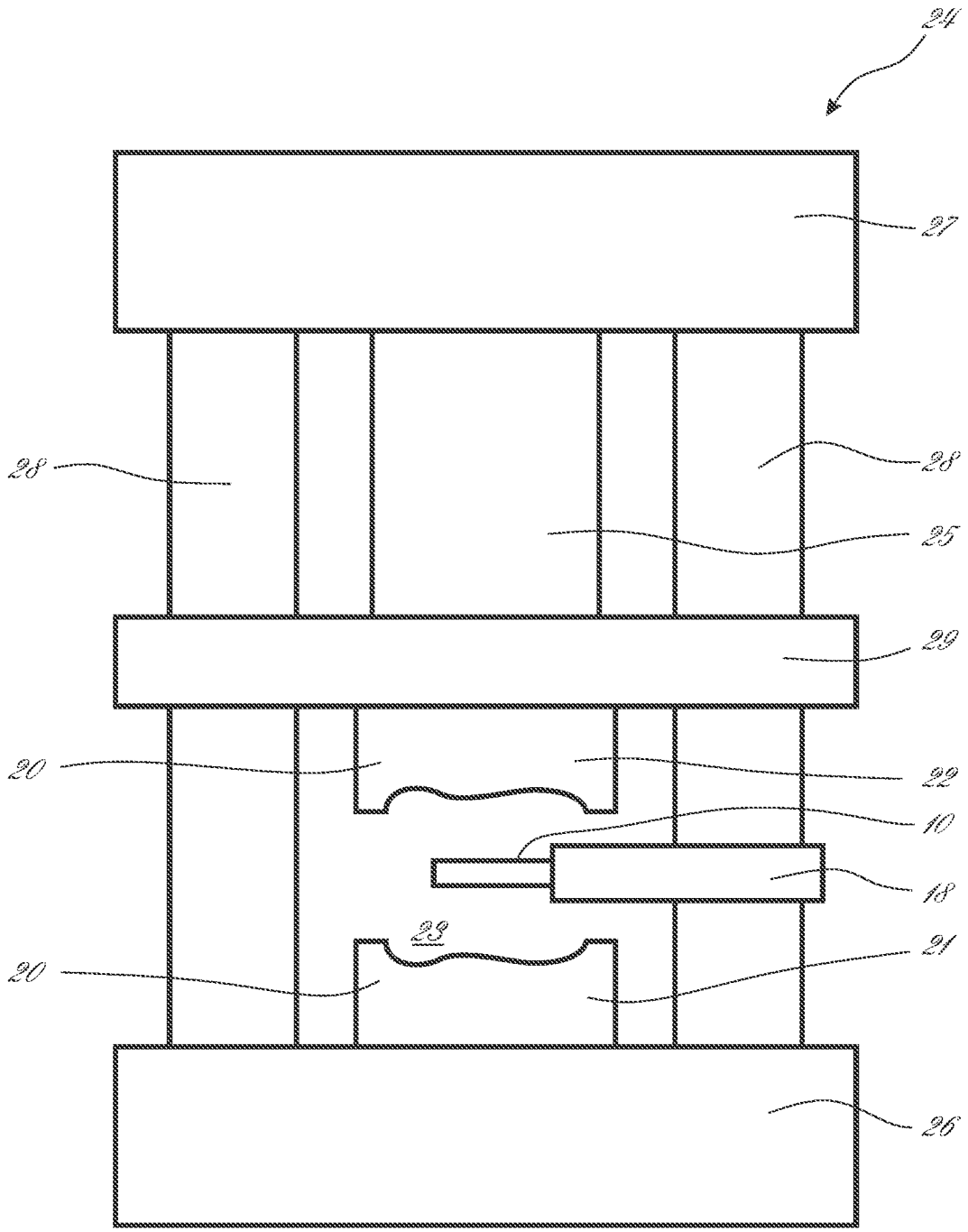
FIG. 3 a schematic side view of a forming machine configured as a die-forging press, with a spray head situated on a spray arm.

The spray head 10 can be used, for example, in the forming machine 24 shown schematically in FIG. 3, which machine is structured as a die-forging press and comprises two dies 20, a lower die 21 and an upper die 22, which can be moved toward one another and away from one another by means of a press cylinder 25.

For this purpose, the forming machine 24 comprises a lower yoke 26 and an upper yoke 27, which are spaced apart from one another by way of tension rods 28, wherein the tension rods 28 can counteract the pressing forces that the press cylinder 25 applies.

A movable yoke 29 is guided on the tension rods 28, which yoke can be moved by the press cylinder 25 for pressing, accordingly, and on which the upper die 22 is attached, so that the upper die 22 can be lowered onto the lower die 21, which is disposed on the lower yoke 26, with every work stroke, with a pressing effect.

As is directly evident, a work space 23 then occurs between the upper and lower die 21, 22, between two work strokes.

Depending on the concrete embodiment, as is well known, the tools, in particular the dies 20, must be lubricated and/or blown out, in particular when work pieces are produced in constantly repeating manner, so as to guarantee proper functioning.

The spray head 10, which can be introduced into the work space 23 by way of a spray arm 18, then serves for this purpose.

REFERENCE SYMBOL LIST

10 spray head
12 top side
14 underside
18 spray arm
20 die
21 lower die
22 upper die
23 work space
24 forming machine
25 press cylinder
26 lower yoke
27 upper yoke
28 tension rod
29 movable yoke
30 two-substance nozzle (numbered as an example)
31 Laval nozzle
32 nozzle body
33 spray air exit
34 sprayed medium exit
35 nozzle exit
36 diameter of the nozzle exit 35
39 distance between nozzle exit 35 and valve 60
40 feed channel (numbered as an example)
45 sprayed medium channel
46 spray air channel
47 control channel
50 spray head foot
55 supply connector
60 valve
61 attachment body
62 sealing ring
65 valve lid
69 spring device
70 housing
80 atomization nozzle

The invention claimed is:

1. An assembly comprising:

a two-substance nozzle; and at least one feed channel connected with the two-substance nozzle, which at least one feed channel is capable of supplying a sprayed medium or a mixture of the sprayed medium and spray air to the two-substance nozzle, wherein a valve is disposed between the at least one feed channel and a nozzle exit of the two-substance nozzle, wherein the two-substance nozzle has a nozzle body that is configured in one piece and comprises the nozzle exit, the valve and an attachment body and a movable module of the valve is attached to the nozzle body by means of using the attachment body, wherein the movable module of the valve is pressed against the nozzle body by the attachment body and/or braced against the nozzle body by a spring device.

2. A spray head for cooling lubrication of at least one die of a forming machine having a lower die and an upper die, which spray head is introduced into a work space between the lower and upper dies between two work strokes, and carries at least one two-substance nozzle according to claim 1.

3. The two-substance nozzle according to claim 1, wherein the attachment body absorbs counter-forces of the spring device and the attachment body and the spring device are configured in one piece.

4. The two-substance nozzle according to claim 1, wherein the valve, which is disposed between the at least one feed channel that supplies the sprayed medium or the mixture of the sprayed medium and spray air to the two-substance nozzle and the nozzle exit of the two-substance nozzle, is opened and closed by a pressure in the at least one feed channel.

5. The two-substance nozzle according to claim 1, further comprising adhesives or sealing agents, wherein the attachment body has a movable module, and wherein the two-substance nozzle and the valve are configured in one piece, except for the movable module of the valve, the movable module of the attachment body, and the adhesives or sealing agents.

6. The two-substance nozzle according to claim 1, wherein the attachment body is connected with the nozzle body in tightly sealed manner and/or wherein the movable module is a valve lid and/or a press-down spring.

7. The two-substance nozzle according to claim 1, wherein the distance between the nozzle exit and the valve amounts to not more than 10 times the maximal diameter of the nozzle exit and/or wherein the two-substance nozzle has a straight-line path for the sprayed medium or the mixture of the sprayed medium and spray air between the valve and the nozzle exit.

8. The two-substance nozzle according to claim 1, wherein the diameter of the nozzle exit amounts to more than 0.5 mm and/or less than 20 mm.

9. A method for using a two-substance nozzle, the method comprising:

providing a two-substance nozzle having a nozzle body that is configured in one piece and comprises a nozzle exit, a valve and an attachment body, passing a sprayed medium or a mixture or of the sprayed medium and spray air to the two-substance nozzle by way of a feed channel and the valve, and spraying out the sprayed medium or the mixture of the sprayed medium and spray air by way of the nozzle exit of the two-substance nozzle, wherein a movable module of the valve is pressed against the nozzle body by the attachment body and/or by a spring device.

* * * * *